US010859308B2

(12) United States Patent
Li et al.

(10) Patent No.: US 10,859,308 B2
(45) Date of Patent: Dec. 8, 2020

(54) STORAGE DEVICE AND REFRIGERATOR HAVING THE SAME

(71) Applicant: QINGDAO HAIER CO., LTD., Qingdao (CN)

(72) Inventors: Dengqiang Li, Qingdao (CN); Bin Fei, Qingdao (CN); Yazhou Shang, Qingdao (CN); Xueli Cheng, Qingdao (CN); Falin Yang, Qingdao (CN); Guangrui Wu, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 0 days.

(21) Appl. No.: 16/486,151

(22) PCT Filed: Nov. 15, 2018

(86) PCT No.: PCT/CN2018/115563
§ 371 (c)(1),
(2) Date: Aug. 14, 2019

(87) PCT Pub. No.: WO2019/100994
PCT Pub. Date: May 31, 2019

(65) Prior Publication Data

US 2020/0232701 A1 Jul. 23, 2020

(30) Foreign Application Priority Data

Nov. 21, 2017 (CN) ..... 2017 1 1167756

(51) Int. Cl.
*F25D 25/00* (2006.01)

(52) U.S. Cl.
CPC ..... *F25D 25/005* (2013.01); *F25D 2325/00* (2013.01)

(58) Field of Classification Search
CPC ..... F25D 25/005; F25D 2325/00
(Continued)

(56) References Cited

U.S. PATENT DOCUMENTS 3,722,031 A * 3/1973 Bourgeois ..... E05F 1/063 16/317
5,138,743 A * 8/1992 Hoffman ..... E05F 1/1223 16/303

(Continued)

FOREIGN PATENT DOCUMENTS

CN 106871560 A 6/2017
CN 206648399 U 11/2017

(Continued)

OTHER PUBLICATIONS

English Machine Translation of KR 10-1299065, KIPO (Year: 2020).*

*Primary Examiner* — Daniel J Troy
*Assistant Examiner* — Timothy M Ayres
(74) *Attorney, Agent, or Firm* — Cheng-Ju Chiang

(57) ABSTRACT

The present invention discloses a storage device and a refrigerator having the same. The storage device comprises a body, an regulating assembly, a first partition frame and a second partition frame, wherein the first partition frame is connected onto a pair of side walls of the body, the second partition frame is rotatably connected onto the first partition frame through the regulating assembly, the regulating assembly comprises: a first regulating mechanism fitted and connected with the first partition frame, on which a first concave-convex curved surface is formed; and a second regulating mechanism fitted and connected with the second partition frame, on which a second concave-convex curved surface is formed; when the first and second regulating mechanisms are relatively rotated, the first and second concave-convex curved surfaces are butted against each other to enable the first and second regulating mechanisms to reciprocate in the vertical direction.

16 Claims, 10 Drawing Sheets

(58) Field of Classification Search
USPC ..... 312/404, 348.3
See application file for complete search history.

(56) References Cited

U.S. PATENT DOCUMENTS

| | | | | |
|---|---|---|---|---|
| 7,296,433 | B2 * | 11/2007 | Uihlein | F25D 23/021 62/441 |
| 8,510,913 | B2 * | 8/2013 | Kim | E05D 11/06 16/268 |
| 8,590,992 | B2 * | 11/2013 | Lim | F25D 25/025 312/404 |
| 8,733,867 | B2 * | 5/2014 | Hwang | F25D 25/025 312/402 |
| 9,207,011 | B2 * | 12/2015 | Song | F25D 25/025 |
| 2012/0030905 | A1 * | 2/2012 | Duan | G06F 1/1681 16/251 |
| 2014/0210331 | A1 * | 7/2014 | Tunzi | F25D 25/00 312/404 |
| 2018/0116399 | A1 * | 5/2018 | Lee | A47B 88/975 |
| 2019/0357679 | A1 * | 11/2019 | Li | F25D 25/022 |

FOREIGN PATENT DOCUMENTS

| | | | |
|---|---|---|---|
| CN | 207585201 | U | 7/2018 |
| KR | 10-2011-0028480 | A | 3/2011 |
| KR | 10-1299065 | B1 | 8/2013 |

* cited by examiner

STORAGE DEVICE AND REFRIGERATOR HAVING THE SAME

The present application is a 35 U.S.C. § 371 National Phase conversion of International (PCT) Patent Application No. PCT/CN2018/115563, filed on Nov. 15, 2018, which claims priority to Chinese Patent Application No. 201711167756.5, filed on Nov. 21, 2017 and tiled "STORAGE DEVICE AND REFRIGERATOR HAVING THE SAME", which is incorporated herein by reference in its entirety. The PCT International Patent Application was filed and published in Chinese.

TECHNICAL FIELD

The invention relates to a storage device and a refrigerator having the same, pertaining to the field of household appliances.

BACKGROUND

A storage device of a refrigerator, such as a drawer, a crisper, a storage box, a bottle rack, or the like, generally has a large accommodation cavity. A variety of food tends to be in a mess when placed therein, which is very inconvenient to take and place food. In particular, the various food is adhered one another when are placed and adhered one another in a drawer of the freezing compartment, which is more inconvenient to take out food from the drawer of the freezing compartment of the refrigerator.

In order to solve the above-mentioned problems, some manufacturers divide the accommodation cavity of the storage device by a partition frame, but such partition frames may only simply divide the accommodation cavity, without freely adjusting partition spaces according to stored articles, with poor flexibility; moreover, with a complicated assembly structure, the partition frame is not easy to disassemble or assemble; the stored articles in different partition spaces tend to slide down and be chaotic, failing to achieve an effect of division.

SUMMARY

The present invention aims to solve at least one of the technical problems existing in the prior art. To achieve the above objective, the present invention provides a storage device and a refrigerator having the same.

To fulfill said objective of the present invention, the present invention provides a storage device. The storage device comprises a body for enclosing an accommodation cavity, a regulating assembly and a first partition frame and a second partition frame for dividing the accommodation cavity, wherein the body comprises a bottom wall, a pair of first side walls and a pair of second side walls, the first partition frame is connected onto the pair of second side walls, the second partition frame is rotatably connected onto the first partition frame around a vertical axis through the regulating assembly, wherein the regulating assembly comprises:

a first regulating mechanism, fitted and connected with one of the first and second partition frames;

a second regulating mechanism, fitted and connected with the other of the first and second partition frames, wherein the first and second regulating mechanisms are rotatably connected with each other around the vertical axis, to drive the second and first partition frames to rotate with respect to each other;

a cam structure, comprising a first concave-convex curved surface formed on the first regulating mechanism and a second concave-convex curved surface formed on the second regulating mechanism;

when the first and second regulating mechanisms are rotated around the vertical axis with respect to each other, the second and first concave-convex curved surfaces are butted against each other, such that the first and second regulating mechanisms make reciprocating salutatory movements away from or close to each other in the vertical direction.

Further, the cam structure has at least two lowest engaging positions where the second and first concave-convex curved surfaces are fitted with each other concavely and convexly, and a highest butting position where the second and first concave-convex curved surfaces are butted against each other concavely and convexly; the second partition frame is rotated with respect to the first partition frame around the vertical axis, such that the storage device is switched between the folded state and the unfolded state; when the storage device is in the folded state, the partition plane of the second partition frame is coplanar with the partition plane of the first partition frame, and the cam structure is located at one of the lowest engaging positions; when the storage device is in the unfolded state, the partition plane of the second partition frame is perpendicular to the partition plane of the first partition frame, and the cam structure is located at the other of the lowest engaging positions.

Further, the cam structure is configured as a circumferentially quartering structure.

Further, when the first and second regulating mechanisms are rotated with respect to each other around the vertical axis and the cam structures are not at the lowest engaging position, the regulating assembly is always subjected to an elastic driving force which drives the cam structures to tend to move to the lowest engaging position, such that the first and second regulating mechanisms have a tendency to move close to each other in the vertical direction.

Further, the number of the first regulating mechanisms is one or more fixed mutually in the vertical direction, and the number of the second regulating mechanisms is two; when the first and second regulating mechanisms are rotated with respect to each other around the vertical axis, the two second regulating mechanisms are moved away from or close to each other in the vertical direction to enable the first or second partition frame fitted and connected with the second regulating mechanism to be deformed elastically; when the cam structures are not at the lowest engaging position the first or second partition frame which is elastically deformed applies the elastic driving force onto the regulating assembly under the action of its elastic restoring force.

Further, two first regulating mechanisms are fixedly connected with each other, and are provided at upper and lower sides of the two first regulating mechanisms respectively.

Further, the second partition frame is slidably connected onto the first partition frame through the regulating assembly; the first partition frame comprises a transverse partition bar which extends in a left-right direction and is configured for dividing the accommodation cavity, the second partition frame comprises a longitudinal partition bar for dividing the accommodation cavity; the first regulating mechanism comprises a first passage, through which, one of the transverse partition bar and the longitudinal partition bar slidably passes; the second regulating mechanism comprises a second passage, through which, the other of the transverse partition bar and the longitudinal partition bar slidably passes.

Further, the first regulating mechanism comprises a third member and a fourth member connected with each other, and the first passage is formed between the third member and the fourth member;

the second regulating mechanism comprises a first member and a second member connected with each other, and the second passage is formed between the first and second members.

Further, the first regulating mechanism comprises a mating pin, and the second regulating mechanism comprises a mating hole which is fitted and connected with the mating pin; when the mating pin is fitted and connected with the mating hole, the relative movement of the first and second regulating mechanisms in the horizontal direction is limited.

In addition, the present invention further provides a refrigerator comprising the storage device.

Compared with a prior art, the present invention has the following advantageous effects. By providing a structure in which a first partition frame is movably coordinated with a second partition frame, the degree of freedom and flexibility of dividing an accommodation cavity are improved to meet different storage demands; an regulating assembly has a delicate structure, such that the rapid assembly may be implemented, and the first and second partition frames are detached/replaced in time, to further improve the division flexibility.

DETAILED DESCRIPTION

Figure 1:
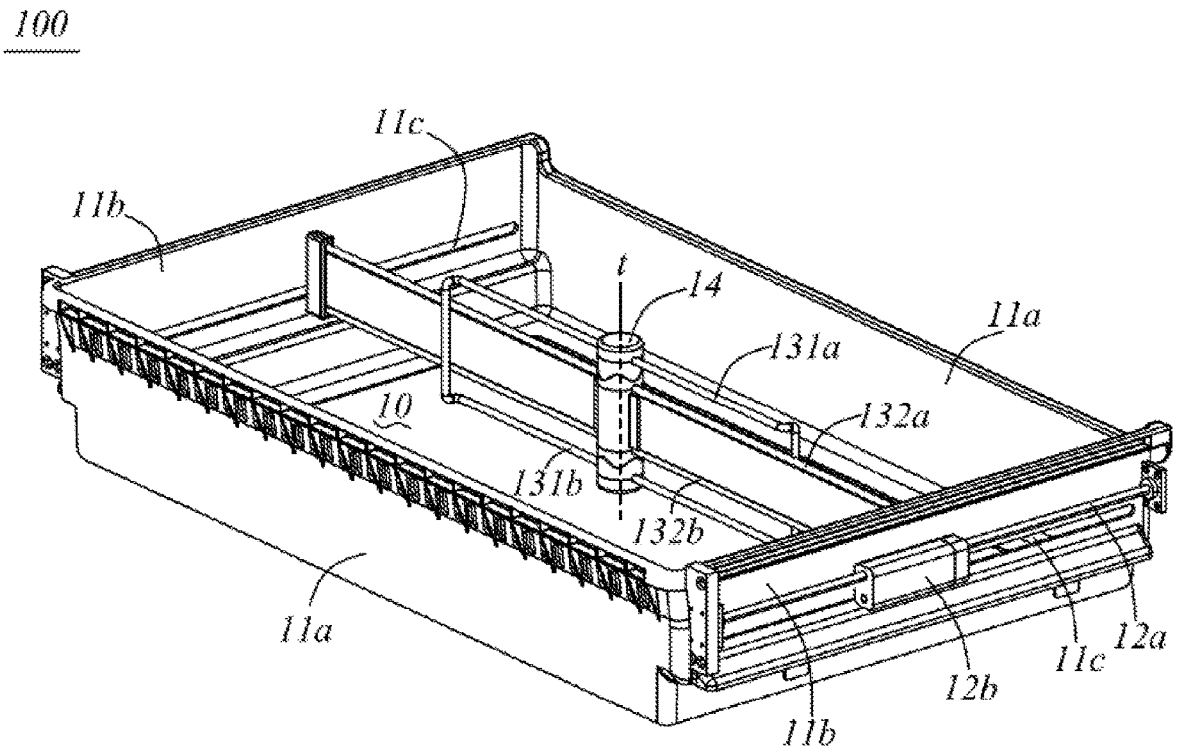
FIG. 1 is a structural diagram of a storage device according to a first embodiment of the present invention, wherein the storage device is in a folded state.

An embodiment of the present invention provides a refrigerator, including a box body and a door, the box body and the door defining at least one storage compartment, which may be a refrigerating compartment, a freezing compartment, a multi zone, or the like. The refrigerator further includes a storage device for storing articles, which is provided in the storage compartment and may be specifically configured as a drawer, a crisper, a storage box, a bottle rack, and the like. Hereinafter, the storage device according to the present invention will be described in detail in conjunction with specific embodiments.

Embodiment 1

Referring to FIGS. 1 to 6*c*, the present embodiment provides a storage device 100, including a body 11, a pair of guiding mechanisms 12, a first partition frame 132, a second partition frame 131 and an regulating assembly 14.

Enclosed by the body 11, an accommodation cavity 10 has an upper opening and is rectangular parallelepiped substantially, for storing various articles, such as food, beverage, or the like. The body 11 includes a bottom wall, a pair of first side walls 11*a* arranged opposite to each other, and a pair of second side walls 11*b* arranged opposite to each other. The bottom wall is configured for carrying articles, and the pair of first side walls 11*a* and the pair of second side walls 11*b* extend perpendicularly upwards from the bottom wall respectively.

In order to clearly express the position and direction described in the present embodiment, the direction defined by a relative position of the pair of first side walls 11*a* is referred to as a front-rear direction (also as a longitudinal direction), and the direction defined by a relative position of the pair of second side walls 11*b* is referred to as a left-right direction (also as a lateral direction). That is, the pair of first side walls 11*a* is arranged front to back, and the pair of second side walls 11*b* is arranged left and right. In addition, the plane defined both by the front-rear direction and the left-right direction is defined as a horizontal plane, and the direction perpendicular to the horizontal plane is defined as a vertical direction.

Figure 2:
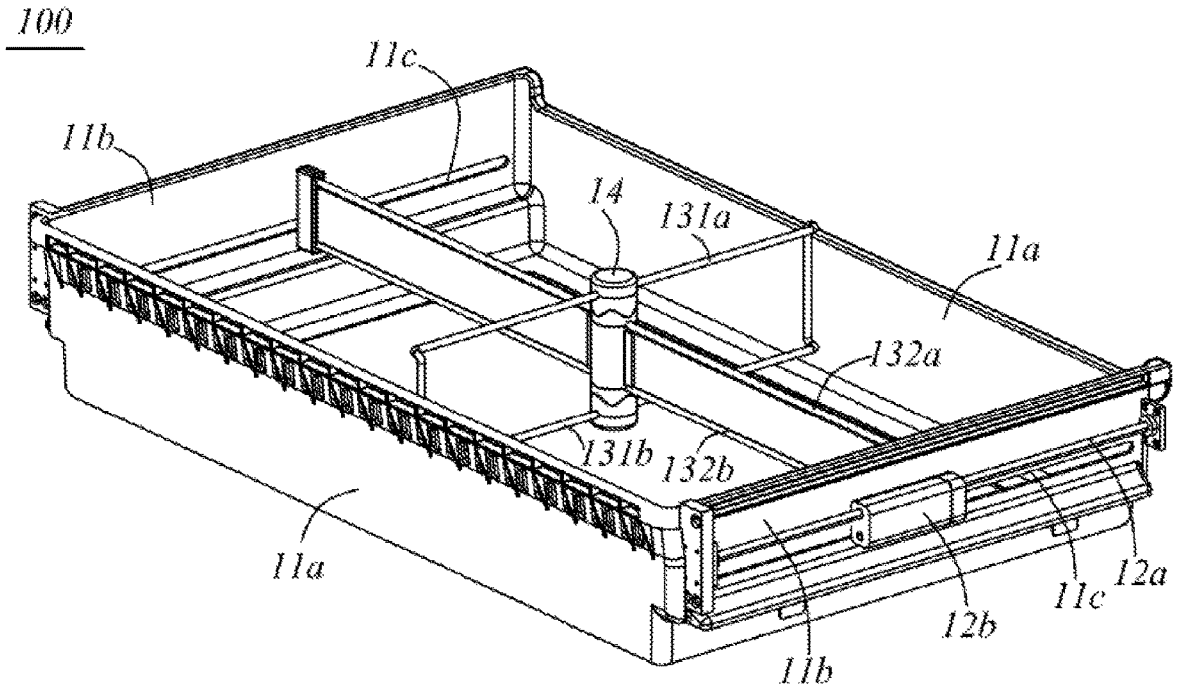
FIG. 2 is a structural exploded diagram of the storage device according to the first embodiment of the present invention.
Figure 3:
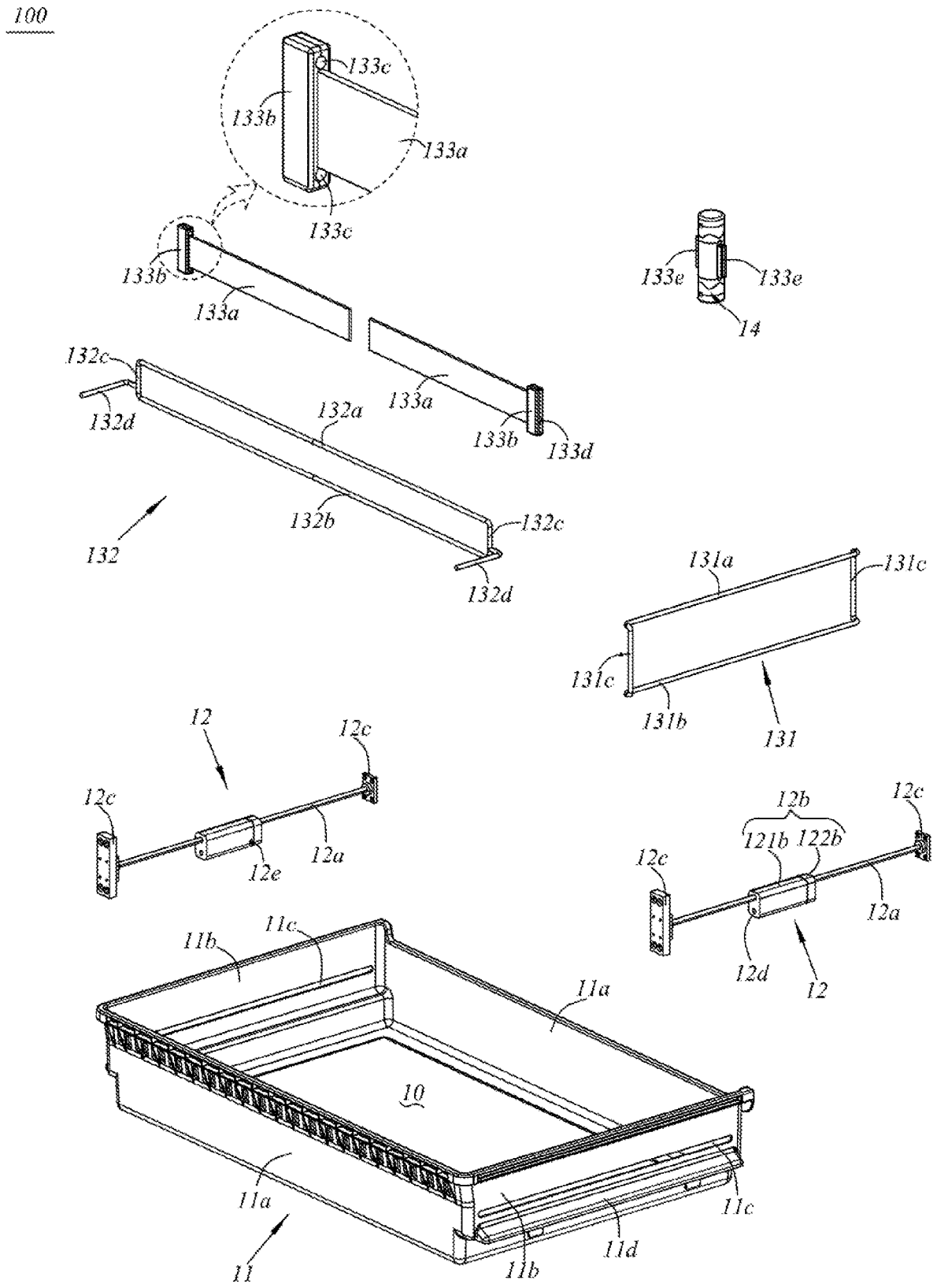
FIG. 3 is a structural diagram of the storage device according to the first embodiment of the present invention, wherein the storage device is in an unfolded state.

Referring to FIGS. 1 and 2, the pair of guiding mechanisms 12 is arranged on the pair of second side walls 11*b* respectively. Referring to FIG. 3, the guiding mechanism 12 includes a guide bar 12*a*, a guiding element 12*b* and fixing bases 12*c*, wherein the guiding mechanism 12 is fixed on the body 11 through the fixing bases 12*c*, the fixing bases 32*c* are fixed with the body 11 in a threaded connection, rivet connection, fastener connection, or the like; parallel with the second side wall 11*b*, the guide bar 12*a* extends in the front-rear direction; the guide bar 12*a* is sleeved with the guiding element 12*b*, the guiding element 12*b* may slide back and forth along the guide bar 12*a*; when the guiding mechanism 12 is fixed to the body 11, the guiding element 12*b* may only slide back and forth with respect to the body 11.

The first partition frame 132 is accommodated in the accommodation cavity 10, for dividing the accommodation cavity 10 in the front-rear direction. Specifically, the first partition frame 132 includes a partition element laterally arranged in the accommodation cavity 10 for dividing the accommodation cavity 10, the vertical plane where the partition element is located is defined as a partition plane of the first partition frame 132, and the accommodation cavity 10 is divided in the front-rear direction by taking the partition plane of the first partition frame 132 as a boundary. In the present embodiment, the partition element includes long transverse partition bars 132*a* and 132*b* which extend left and right and are arranged spaced apart from each other in the vertical direction.

The first partition frame 132 further includes a pair of connectors 132*c* which is configured for connecting an end portion of the transverse partition bar 132*a* with an end portion of the transverse partition bar 132*b*, and enclosing a rectangular frame together with the transverse partition bars 132*a*, 132*b*.

The first partition frame 132 is slidably connected onto the body 11 in the front-rear direction through the guiding mechanism 12, for adjusting the size and/or number of the storage partitions formed by dividing the accommodation cavity 10 in the front-rear direction.

Specifically, the first partition frame 132 includes a pair of fixing portions 132*d* formed at left and right ends of the first partition frame 132, and each of the fixing portions 132*d* is connected onto the corresponding guiding element 12*b*. When the guiding element 12*b* slides back and forth along the guide bar 12*a*, the first partition frame 132 slides back and forth in the accommodation cavity 10 synchronously.

The fixing portion 132*d* is insertably fitted with the guiding element 12*b*. The fixing portion 132*d* is specifically provided in a shape of a long bar, and extends in a direction perpendicular to an extension direction (left-right direction) of the transverse partition bars 132*a*, 132*b*; the guiding element 12*b* includes a mounting hole 12*d* matched with the fixing portion 132*d*, and the fixing portion 132*d* may be insertably fitted into the mounting hole 12*d* in its extension direction. When the fixing portion 132*d* is inserted into the mounting hole 12*d*, the fixing portion 132*d* and the mounting hole 12*d* are limited mutually in the left-right direction, so that the fixing portion 132*d* cannot move left and right with respect to the guiding element 12*b*; the pair of guiding elements 12*b* limits the first partition frame 132, such that the first partition frame 132 cannot move left and right with respect to the body 11, so as to enhance the stability of the first partition frame 132.

An outer surface of each of the guiding elements 12*b* is butted against the corresponding second side wall 11*b*. In this way, when the first partition frame 132 tends to move leftward or rightward with respect to the body 11, one of the guiding elements 12*b* may limit the tendency of leftward movement of the first partition frame 132 by butting against the corresponding second side wall 11*b*, and the other of the guiding elements 12*b* may limit the tendency of rightward movement of the first partition frame 132 by butting against the corresponding second side wall 11*b*.

In the present embodiment, the guiding mechanism 12 is provided at an exterior of the body 11 away from the accommodation cavity 10, specifically outside the corresponding second side wall 11*b*. An inner side of each of the guiding elements 12*b* abuts against the corresponding second side wall 11*b* respectively, thereby enhancing the stability of the guiding element 12*b* when sliding, and preventing the first partition frame 132 from swaying from side to side with respect to the body 11 in use.

Each of the second side walls 11*b* is provided thereon with a guide groove 11*c* extending in the front-rear direction. The left and right ends of the first partition frame 132 pass through the guide groove 11*c* and then are connected onto the guiding mechanism 12. Specifically, the fixing portion 132*d* passes through the guide groove 11*c* from the accommodation cavity 10, and then is fitted and connected into the mounting hole 12*d* of the guiding element 12*b*.

In the present embodiment, the fixing portion 132*d* extends in a direction parallel with the extension direction of the guide groove 11*c*, i.e., the fixing portion 132*d* also extends in the front-rear direction, so that not only the first partition frame 132 is prevented from shaking from side to side with respect to the body 11 in use, but also the fixing portion 132*d* is conveniently disassembled from the guiding element 12*b*, thereby facilitating the assembly and disassembly of the first partition frame 132.

Further, the guiding element 12*b* includes a first guiding element 121*b* and a second guiding element 122*b* which are separately provided, and the first and second guiding elements 121*b* and 122*b* are detachably assembled with each other. The mounting hole 12*d* is provided on the first guiding element 121*b*, and a passage 12*e* is enclosed by the first and second guiding elements 121*b* and 122*b*, and is communicated with the mounting hole 12*d*. When the first and second guiding elements 121*b* and 122*b* are separated from each other, the fixing portion 132*d* may be inserted into the mounting hole 12*d* from between the first and second guiding elements 121*b* and 122*b*, and then the first and second guiding elements 121*b* and 122*b* are assembled with each other, such that the second guiding element 122*b* limits the fixing portion 132*d* to prevent the fixing portion 132*d* from being off the mounting hole 12*d*.

Referring to FIGS. 1 to 3, the second partition frame 131 is accommodated in the accommodation cavity 10 for dividing the accommodation cavity 10 in the left-right direction. In the present embodiment, the second partition frame 131 is rotatably connected onto the first partition frame 132 around a vertical axis t through a regulating assembly 14. According to the positional relation between the second partition frame 131 and the first partition frame 132, the storage device 100 has a folded state (referring to FIG. 1) and an unfolded state (referring to FIG. 3). By rotatably connecting the second partition frame 131 onto the first partition frame 132, the number of storage partitions formed by dividing the accommodation cavity 10 may be adjusted, and the flexibility of dividing the accommodation cavity 10 is improved.

The second partition frame 131 includes a partition body for dividing the accommodation cavity 10, and the vertical plane where the partition body is located is defined as the partition plane of the second partition frame 131. A transverse width of the accommodation cavity 10 (that is, a spacing between the pair of second side walls 11*b*) is greater than a longitudinal width of the accommodation cavity 10 (that is, a spacing between the pair of first side walls 11*a*). Correspondingly, the width of the partition plane of the first partition frame 132 is greater than that of the partition plane of the second partition frame 131, i.e., a length of the partition element is greater than that of the partition body.

In the present embodiment, the partition body includes long longitudinal partition bars 131*a* and 131*b* which are parallel with each other and arranged spaced apart from each other in the vertical direction.

Referring to FIG. 1, when the storage device 100 is in the folded state, the partition plane of the second partition frame 131 is coplanar with the partition plane of the first partition frame 132. The longitudinal partition bars 131*a*, 131*b* and the transverse partition bars 132*a*, 132*b* all extend in the left-right direction and are located in the same vertical plane. In this way, the occupied space of the second partition frame 131 not in use may be reduced, and the cleanliness and aesthetic degree are improved. Referring to FIG. 3, when the storage device 100 is in the unfolded state, the second partition frame 131 is crossed with the first partition frame 132, the accommodation cavity 10 may be divided in the front-rear direction by taking the partition plane of the first partition frame 132 as a boundary, and in the left-right direction by taking the partition plane of the second partition frame 131 as a boundary. At this point, a non-zero included angle is formed between the partition plane of the second partition frame 131 and the partition plane of the first partition frame 132. In the present embodiment, at this point, the partition plane of the second partition frame 131 is perpendicular to the partition plane of the first partition frame 132. Specifically, the longitudinal partition bars 131*a*, 131*b* extend in the front-rear direction, the transverse partition bars 132*a*, 132*b* extend in the left-right direction, and the longitudinal partition bars 131*a*, 131*b* are perpendicular to the transverse partition bars 132*a*, 132*b*.

Further, the partition element may further include a glass partition plate 133*a*, which is selectively assembled by a user between the first fixing element 133*b* and the second fixing element 133*e*. The partition plate 133*a* is assembled onto the connector 132*c* through the first fixing element 133*b*, and is detachably connected onto the regulating assembly 14 through the second fixing element 133*e*. By providing the partition plate 133*e*, the articles stored in the storage partitions at front and rear sides of the first partition frame 132 are not in contact, which avoids tainting, and prevents the stored articles from sliding down crossly from between the transverse partition bars 132*a* and 132*b*. Certainly, in a variation, the partition plate 133*e* is not only located between the transverse partition bars 132*a* and 132*b*, but also partially extends upwards to above the transverse partition bar 132*a*, and/or partially extends downwards to below the transverse partition bar 132*b*.

In the vertical direction, the longitudinal partition bars 131*a* and 131*b* are arranged adjacent to each other, the longitudinal partition bar 131*a* is higher than an upper boundary of the partition element all along (in the present embodiment, the transverse partition bar 132*a*), and the longitudinal partition bar 131*b* is lower than a lower boundary of the partition element all along (in the present embodiment, the transverse partition bar 132*b*). The longitudinal partition bar 131*a*, the transverse partition bars 132*a*, the partition plate 133*a*, the transverse partition bar 132*b*, and the longitudinal partition bar 131*b* are arranged sequentially in the vertical direction. In this way, when the storage device 100 is in the folded state, the second partition frame 131 does not interfere with the partition plate 133*a*.

Further, the second partition frame 131 may also slidably connected onto the first partition frame 132 through the regulating assembly 14, i.e., the second partition frame 131 is not only slidable with respect to the first partition frame 132, but also rotatable around the vertical axis t, thereby adjusting the number and/or size of the storage partitions formed by dividing the accommodation cavity 10 as needed.

The above-mentioned second partition frame 131 may be slidably connected onto the first partition frame 132 through the regulating assembly 14 in a plurality of manners. Firstly, the first partition frame 132 is not slidably connected to the regulating assembly 14, and the second partition frame 131 is slidably connected to the regulating assembly 14, thereby adjusting the size/number of the storage partitions formed by dividing the accommodation cavity 10 by the first partition frame 132 in the front-rear direction; secondly, the first partition frame 132 is slidably connected to the regulating assembly 14, and the second partition frame 131 is not slidably connected to the regulating assembly 14, thereby adjusting the size/number of the storage partition formed by dividing the accommodation cavity 10 by the second partition frame 131 in the left-right direction; thirdly, as in the present embodiment, the first partition frame 132 is slidably connected to the regulating assembly 14, and the second partition frame 131 is also slidably connected to the regulating assembly 14, thereby regulating the size/number of the storage partitions formed by dividing the accommodation cavity 10 by the first and second partition frames 132 and 131 in the front-rear direction and the left-right direction, and further improving the flexibility.

The specific structure of the regulating assembly 14 will be described in detail below with reference to FIGS. 4*a*-5. In the present embodiment, the regulating assembly 14 is provided as a cylindrical structure with mirror symmetry along a horizontal plane q. Certainly, in the variation, its shape and structure are not limited to the present embodiment.

The regulating assembly 14 includes a first regulating mechanism and a second regulating mechanism. The first regulating mechanism is fitted and connected with one of the first and second partition frames 132 and 131, and the second regulating mechanism is fitted and connected with the other of the first and second partition frames 132 and 131. In the present embodiment, the first regulating mechanism is fitted and connected with the first partition frame 132, and two first regulating mechanisms are provided, i.e., the first regulating mechanism 142*a* which is fitted and connected with the transverse partition bar 132*a* and the first regulating mechanism 142*b* which is fitted and connected with the transverse partition bar 132*b*; the second regulating mechanism is fitted and connected with the second partition frame 131, and two second regulating mechanisms are provided, i.e., the second regulating mechanism 141*a* which is fitted and connected with the longitudinal partition bar 131*a* and the second regulating mechanism 141*b* which is fitted and connected with the longitudinal partition bar 131*b*; the first regulating mechanism 142*b* is matched with the second regulating mechanism 141*b*, and the first regulating mechanism 142*b* is matched with the second regulating mechanism 141*b*.

The first regulating mechanism 142*a* includes a third member 43*a*, a fourth member 44*a*, and a first passage 145*a*. The third member 43*a* includes two hooks 434*a* and a groove 433*a*; the fourth member 44*a* includes two slots 441*a* and a groove 442*a*; the two hooks 434*a* are fastened and connected with the two slots 441*a* in one-to-one correspondence, such that the third member 43*a* and the fourth member 44*a* are fitted and connected with each other; the first passage 145*a* is formed between the third member 43*a* and the fourth member 44*a*, and is specifically enclosed by the grooves 433*a* and 442*a*, thereby conveniently matching and connecting the first regulating mechanism 142*a* with the transverse partition bar 132*a*. The transverse partition bar

132*a* passes through the first passage 145*a*, such that the first regulating mechanism 142*a* slides along the transverse partition bar 132*a*.

Similarly, the first regulating mechanism 142*b* is fitted and connected with the transverse partition bar 132*b*, and the specific structure thereof refers to the structure of the first regulating mechanism 142*a*, without repetition herein. The first passage 145*a* is parallel with the first passage 145*b*, and the regulating assembly 14 is slidably connected to the first partition frame 132 in the left-right direction.

The second regulating mechanism 141*a* includes a first member 41*a*, a second member 42*a*, and a second passage 144*a*. The first member 41*a* includes two hooks 411*a* and a groove 412*a*; the second member 42*a* includes two slots 421*a* and a groove 422*a*; the two hooks 411*a* are fastened and connected with the two slots 421*a* in one-to-one correspondence, such that the first member 41*a* and the second member 42*a* are fitted and connected with each other; the second passage 144*a* is formed between the first member 41*a* and the second member 42*a*, and is specifically enclosed by the grooves 422*a* and 412*a*, thereby conveniently matching and connecting the second regulating mechanism 141*a* with the longitudinal partition bar 131*a*. The longitudinal partition bar 131*a* passes through the second passage 144*a*, such that the second regulating mechanism 141*a* slides along the longitudinal partition bar 131*a*.

Similarly, the second regulating mechanism 141*b* is fitted and connected with the longitudinal partition bar 131*b*, and the specific structure thereof refers to the structure of the second regulating mechanism 141*a*, without repetition herein. The second passage 141*a* is parallel with the second passage 141*b*, and the regulating assembly 14 is slidably connected to the second partition frame 131.

Further, the first regulating mechanism 142*a* includes a mating pin 432*a*, and the second regulating mechanism 141*a* includes a mating hole matched with the mating pin 432*a*; the mating pin 432*a* may be insertably fitted with the mating hole of the second regulating mechanism 141*a* in the vertical direction, and the mating pin 432*a* and the mating hole have matched cylindrical mating surfaces, such that the first and second regulating mechanisms 142*a* and 141*a* are fitted and connected and are rotated relatively around the vertical axis t. In the present embodiment, the second regulating mechanism 141*a* is rotated around the vertical axis t (with reference to the body 11). Similarly, the second regulating mechanism 141*b* includes a mating hole 424*b*, and the first regulating mechanism 142*b* includes a mating pin matched with the mating hole 424*b*; the mating hole 424*b* may be insertably fitted with the mating pin of the first regulating mechanism 142*b* in the vertical direction, and the mating hole 424*b* and the mating pin have matched cylindrical mating surfaces, such that the first and second regulating mechanisms 142*b* and 141*b* are fitted and connected and are rotated relatively around the vertical axis t. In the embodiment, the second regulating mechanism 141*b* is rotated around the vertical axis t (with reference to the body 11).

Moreover, when the mating holes of the mating pin 432*a* and the second regulating mechanism 141*a* are fitted and connected, the two are limited mutually, such that the relative displacement of the first and second regulating mechanisms 142*a* and 141*a* in the horizontal direction is limited, thereby avoiding shaking. Similarly, when the mating hole 424*b* is fitted and connected with the mating pin of the first regulating mechanism 142*b*, the two are limited mutually, such that the relative displacement of the first and second regulating mechanisms 142*b* and 141*b* in the horizontal direction is limited, thereby avoiding shaking.

In this way, with the relative rotation of the first regulating mechanisms 142*a*, 142*b* and the second regulating mechanisms 141*a*, 141*b*, the first and second partition frames 132 and 131 are rotated around the vertical axis t with respect to each other, so that the storage device 100 is switched between the folded state and the unfolded state.

Specifically, the regulating assembly 14 further includes a cam structure formed between the first and second regulating mechanisms. In the present embodiment, the number of the cam structures is two, i.e., the cam structure 143*a* formed between the first and second regulating mechanisms 142*a* and 141*a*, and the cam structure 143*b* formed between the first and second regulating mechanisms 142*b* and 141*b*. Certainly, in the variation, only one of the cam structures 143*a* and 143*b* may be provided.

Taking the cam structure 143*a* as an example, the specific structure of the cam structure will be described (the specific structure of the cam structure 143*b* refers to that of the cam structure 143*a*, and will not be repeated herein). The cam structure 143*a* includes a first concave-convex curved surface 431*a* with a circumferentially-waved shape formed on an upper end surface of the first regulating mechanism 142*a*, and a second concave-convex curved surface 432*a* with a circumferentially-waved shape formed on a lower end surface of the second regulating mechanism 141*a*, the first and second concave-convex curved surfaces 431*a* and 423*a* are fitted with each other; and when the first and second regulating mechanisms 142*a* and 141*a* are rotated around the vertical axis t with respect to each other, the second and first concave-convex curved surfaces 423*a* and 431*a* are butted against each other, such that the first and second regulating mechanisms 142*a* and 141*a* make reciprocating salutatory movements away from or close to each other in the vertical direction.

The cam structure 143*a* has at least two lowest engaging positions (referring to FIGS. 4*a* and 4*c*) where the second and first concave-convex curved surfaces 423*a* and 431*a* are fitted with each other concavely and convexly, and a highest butting position (referring to FIG. 4*b*) where the second and first concave-convex curved surfaces 423*a* and 431*a* are butted against each other concavely and convexly. When the cam structure 143*a* is moved from the lowest engaging position to the highest butting position, the first and second regulating mechanisms 142*a* and 141*a* are away from each other in the vertical direction; when the cam structure 143*a* is moved from the highest butting position to the lowest engaging position, the first and second regulating mechanisms 142*a* and 141*a* are close to each other in the vertical direction.

Figure 4A:
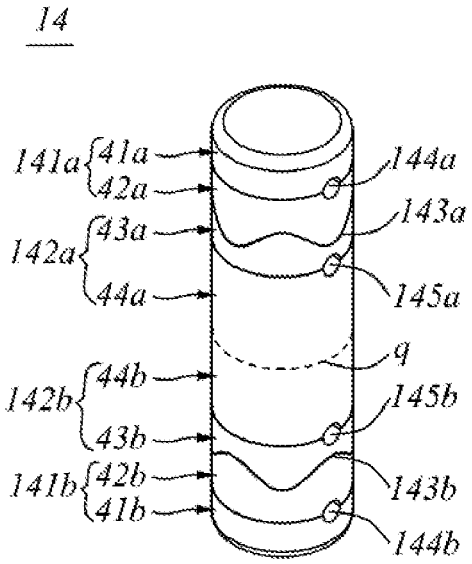
FIG. 4*a* is a structural diagram when an regulating assembly according to the first embodiment of the present invention is in a first engaged state.
Figure 4B:
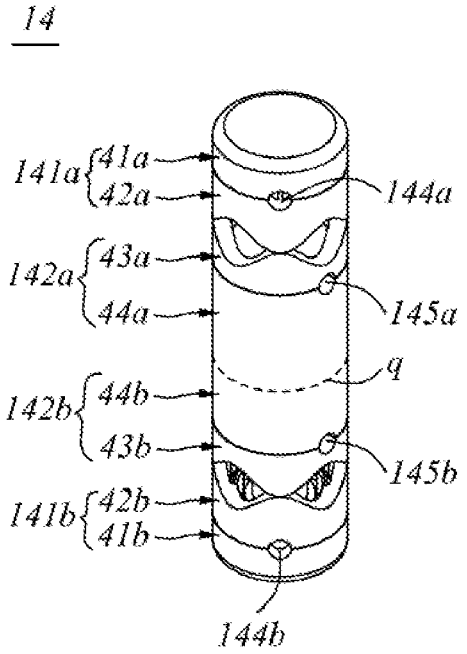
FIG. 4*b* is a structural diagram of the regulating assembly according to the first embodiment of the present invention in a critical state.
Figure 5:
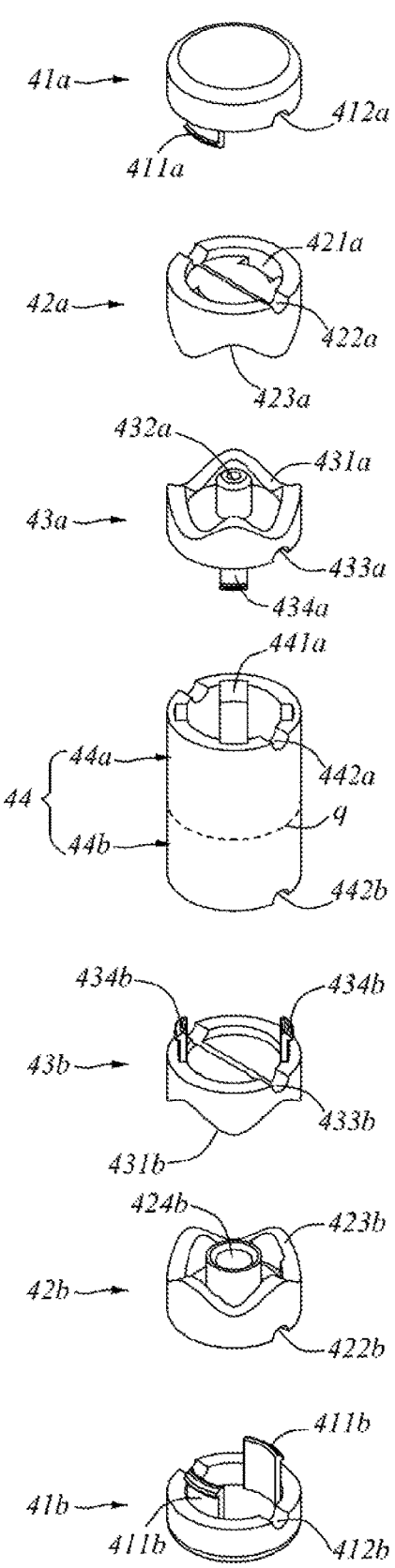
FIG. 5 is a structural exploded diagram of the regulating assembly according to the first embodiment of the present invention.

When the second partition frame 131 is rotated around the vertical axis t with respect to the first partition frame 132, by taking the process of changing the storage device 100 from the folded state to the unfolded state (contrary to the process of changing the storage device 100 from the unfolded state to the folded state) as an example:

referring to FIG. 4*a*, when the storage device 100 is in the folded state, the regulating assembly 14 is in a first engaging state; at this point, the first passages 145*a*, 145*b* are parallel with the second passages 144*a*, 144*b*; correspondingly, the partition plane of the first partition frame 132 is parallel with that of the second partition frame 131, and the cam structures 143*a*, 143*b* are both at one of the lowest engaging positions;

referring to FIG. 4*b*, when the storage device 100 is switched from the folded state to the unfolded state, during the process that the regulating assembly 14 changes from the first engaging state into a critical state, the cam structures

Figure 4C:
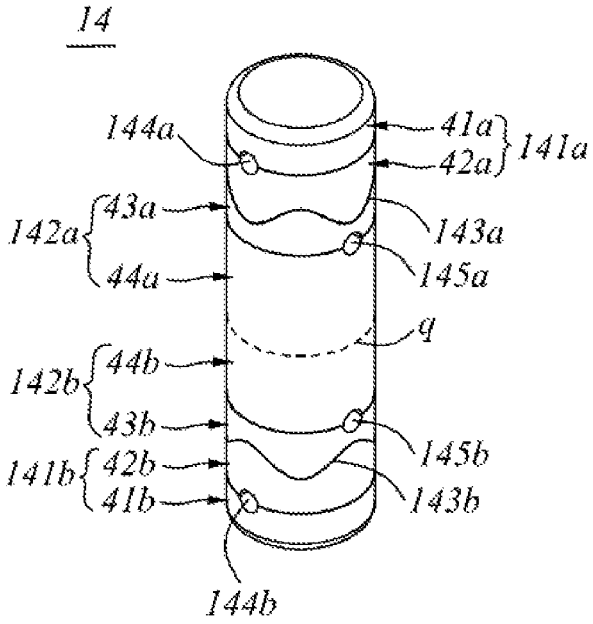
FIG. 4*c* is a structural diagram when the regulating assembly according to the first embodiment of the present invention is in a second engaged state.

143*a*, 143*b* are both moved from the lowest engaging position to the highest butting position, the first and second regulating mechanisms 142*a* and 141*a* are away from each other in the vertical direction, and the first and second regulating mechanisms 142*b* and 141*b* are away from each other in the vertical direction, until the regulating assembly 14 is in the critical state, and the cam structures 143*a*, 143*b* are both at the highest butting position; and then, during the process that the regulating assembly 14 changes from the critical state into the second engaging state, the first and second regulating mechanisms 142*a* and 141*a* are close to each other in the vertical direction, and the first and second regulating mechanisms 142*b* and 141*b* are close to each other in the vertical direction;

referring to FIG. 4*c*, when the storage device 100 is in the unfolded state, the regulating assembly 14 is in the second engaging state; at this point, the first passages 145*a*, 145*b* are perpendicular to the second passages 144*a*, 144*b*; correspondingly, the partition plane of the first partition frame 132 is perpendicular to that of the second partition frame 131, and the cam structures 143*a*, 143*b* are both at the other of the lowest engaging positions.

Further, the cam structures 143*a*, 143*b* are both configured as a circumferentially quartering structure, i.e., when the cam structures 143*a*, 143*b* are changed between the two adjacent lowest engaging positions, the first and second regulating mechanism 142*a* and 141*a* are rotated with respect to each other by 90° around the vertical axis t, and the first and second regulating mechanisms 142*b* and 141*b* are rotated with respect to each other by 90° around the vertical axis t. Further, the second partition frame 131 is rotated by 90° with respect to the first partition frame 132 around the vertical axis t, such that the storage device 100 is switched between the folded state and the unfolded state to finish a turnover cycle.

At the same time, when the cam structures 143*a*, 143*b* are changed between the lowest engaging position and the highest butting position, the first and second regulating mechanisms 142*a* and 141*a* are rotated with respect to each other by 45° around the vertical axis t, and the first and second regulating mechanisms 142*b* and 141*b* are rotated with respect to each other by 45° around the vertical axis t.

Certainly, in the variation, the cam structures 143*a*, 143*b* may also be configured as circumferentially inequant or multi-equant structures (such as the structure divided into three, five, six, eight equal parts, or the like) according to the specific requirements of a rotation angle of the storage device 100 switched from the folded state to the unfolded state. These variations do not deviate from the technical principle of the present invention.

Further, when the cam structures 143*a*, 143*b* are not at the lowest engaging position, the regulating assembly 14 is always subjected to an elastic driving force which drives the cam structures 143*a*, 143*b* to move to the lowest engaging position, i.e., the elasticity driving force drives the first and second regulating mechanisms 142*a* and 141*a* to have a tendency to be close to each other in the vertical direction and drives the first and second regulating mechanisms 142*b* and 141*b* to have a tendency to be close to each other in the vertical direction.

In the present embodiment, the elastic driving force is provided by the second partition frame 131. Specifically, the second partition frame 131 is made of a rigid material, and further includes a pair of connecting rods 131*c* for connecting the end portion of the longitudinal partition bar 131*a* and the end portion of the longitudinal partition bar 131*b*; the fourth member 44*a* and the fourth member 44*b* are integrally formed, the fourth member 44*a* is provided as an upper half part of a structural element 44, and the fourth member 44*b* is provided as a lower half part of the member 44, such that the first regulating mechanisms 142*a*, 142*b* are fixedly connected in the vertical direction. When the cam structures 143*a*, 143*b* are at the lowest engaging position, the second partition frame 131 is not elastically deformed, and the longitudinal partition bars 131*a*, 131*b* are parallel with each other and have an initial spacing; when the cam structures 143*a*, 143*b* are not at the lowest engaging position (including between the lowest engaging position and the highest butting position and at the highest butting position), driven by the second regulating mechanisms 141*a*, 141*b*, a local spacing of the longitudinal partition bars 131*a*, 131*b* close to the regulating assembly 14 is greater than the initial spacing, and the initial spacing is maintained at the end portion by the pulling of the connecting rod 131*c*, and then the second partition frame 131 is elastically deformed, and applies the elastic driving force onto the regulating assembly 14.

In this way, in one turnover cycle of the storage device 100 switched between the folded state and the unfolded state: under the action of an external force, the second partition frame 131 is rotated with respect to the first partition frame 132 around the vertical axis t, the regulating assembly 14 is changed from the first engaging state to the critical state (or from the second engaging state to the critical state), the cam structures 143*a*, 143*b* are both moved from the lowest engaging position to the highest butting position, the second regulating mechanisms 141*a*, 141*b* are away from each other in the vertical direction to drive the second partition frame 131 to be elastically deformed; when the regulating assembly 14 reaches the critical state, the cam structures 143*a*, 143*b* are both at the highest butting position, the second partition frame 131 is elastically deformed furthest; over the critical state, under the elastic restoring force of the second partition frame 131, the second regulating mechanisms 141*a*, 141*b* are close to each other in the vertical direction, and the regulating assembly 14 is changed from the critical state to the second engaging state (or from the critical state to the first engaging state), such that the storage device 100 is changed from the folded state to the unfolded state (or from the unfolded state to the folded state).

Certainly, in the variation, the storage device 100 may further include an elastic element which provides the elastic driving force, and the elastic element is provided between the first and second regulating mechanisms. When the cam structure is not at the lowest engaging position, the elastic element is elastically deformed.

Further, the connecting rod 131*c* is provided not to be coplanar with the longitudinal partition bars 131*a*, 131*b*. When the storage device 100 is in the folded state, the pair of connecting rods 131*c* abut against the transverse partition bars 132*a* and 132*b* and are located at front and rear sides of the first partition frame 132 respectively.

Figure 6A:
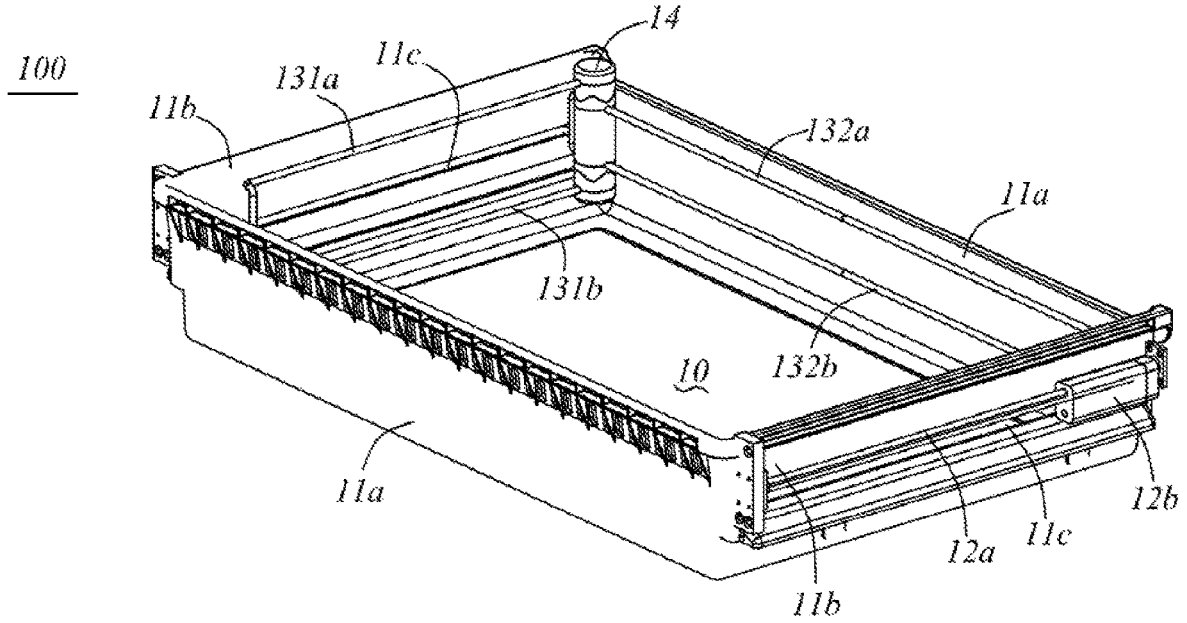
FIG. 6*a* is a structural diagram of the storage device according to the first embodiment of the present invention, which shows a state when the accommodation cavity has no partition.
Figure 6B:
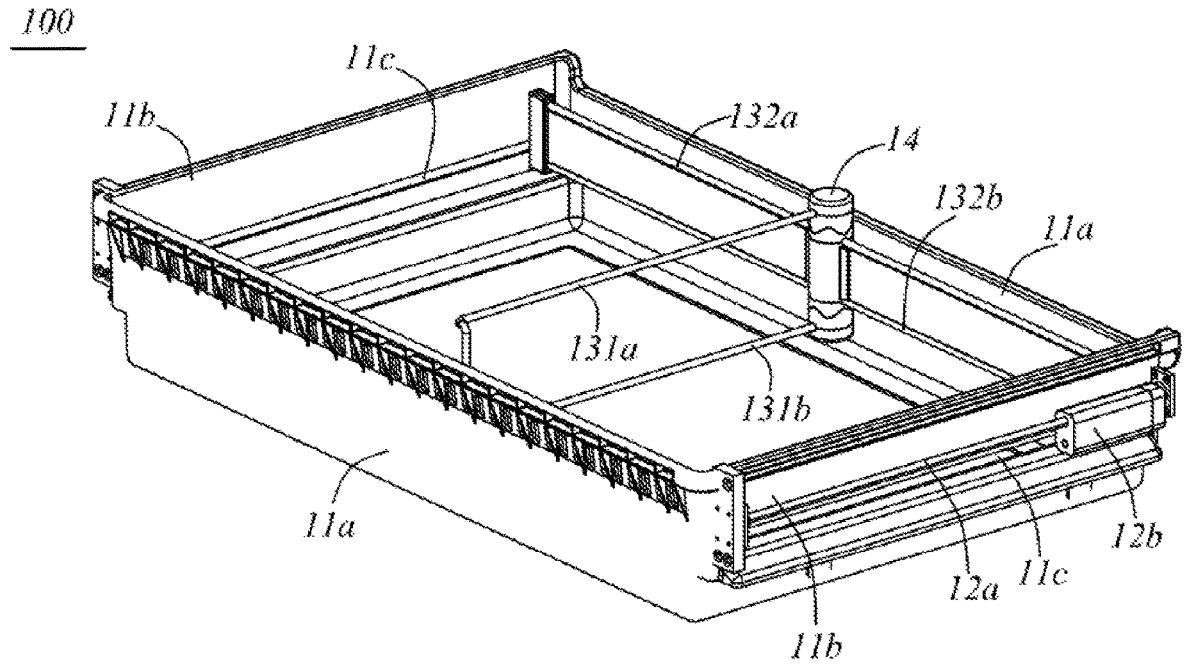
FIG. 6*b* is a structural diagram of the storage device according to the first embodiment of the present invention, which shows a state when the accommodation cavity has two partitions.
Figure 6C:
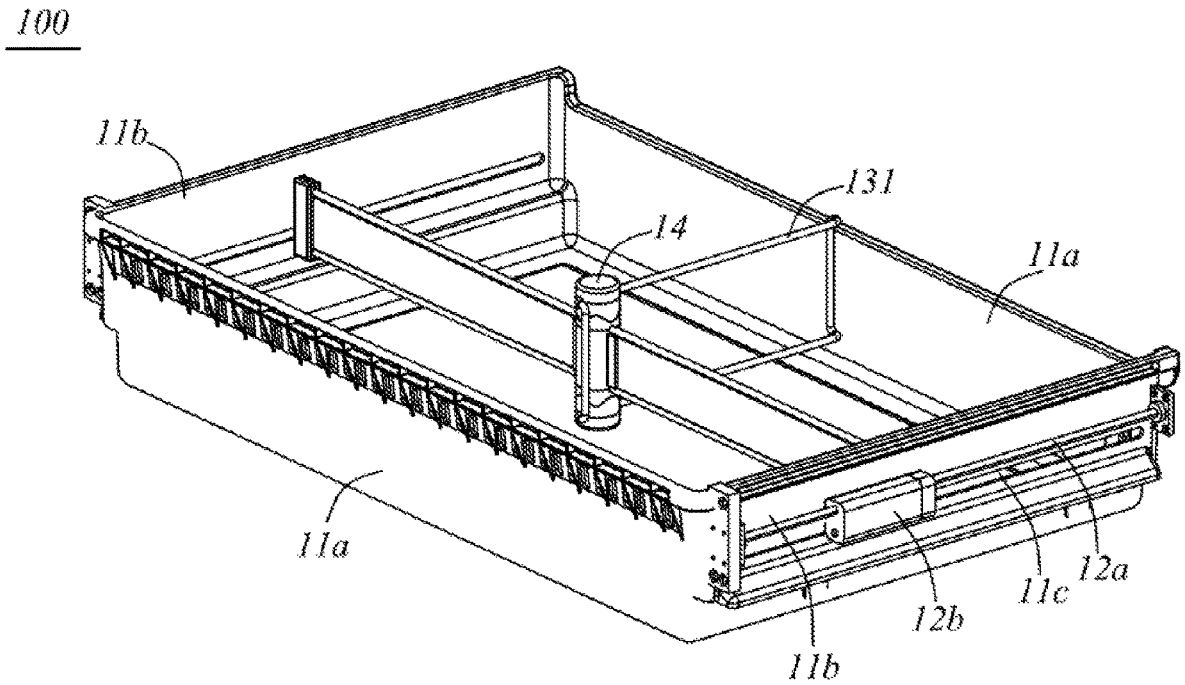
FIG. 6*c* is a structural diagram of the storage device according to the first embodiment of the present invention, which shows a state when the accommodation cavity has three partitions.

Compared with the prior art, the storage device 100 according to the present embodiment may adjust the number/size of the storage partitions formed by dividing the accommodation cavity 10 as needed. For example, with the movements of the first partition frame 132 and/or the second partition frame 131, the area without partition as shown in FIG. 6*a*, the area with two partitions in FIG. 6*b* or 1, and the area with four partitions in FIG. 3 is formed, or by detaching or replacing the second partition frame 131, the area with three partitions as shown in FIG. 6*c* is formed; and the first partition frame 132 is convenient to be disassembled and assembled, and has good stability in use; the storage partitions formed by dividing the first partition frame 132 may prevent articles from falling down crosswise.

Embodiment 2

Referring to FIGS. 7 to 9*c*, the present embodiment provides a storage device 200, including a body 21, a pair of guiding mechanisms 22, a first partition frame 232, a second partition frame 231 and an regulating assembly 24.

Enclosed by the body 21, an accommodation cavity 20 has an upper opening and is rectangular parallelepiped substantially, for storing various articles, such as food, beverage, or the like. Specifically, the body 21 includes a bottom wall, a pair of first side walls 21*a* arranged opposite to each other, and a pair of second side walls 21*b* arranged opposite to each other. The bottom wall is configured for carrying articles, and the pair of first side walls 21*a* and the pair of second side walls 21*b* extend perpendicularly upwards from the bottom wall respectively.

In order to clearly express the position and direction described in the present embodiment, the direction defined by a relative position of the pair of first side walls 21*a* is referred to as a front-rear direction (also as a longitudinal direction), and the direction defined by a relative position of the pair of second side walls 21*b* is referred to as a left-right direction (also as a lateral direction). That is, the pair of first side walls 21*a* is arranged front to back, and the pair of second side walls 11*b* is arranged left and right. In addition, the plane defined both by the front-rear direction and the left-right direction is defined as a horizontal plane, and the direction perpendicular to the horizontal plane is defined as a vertical direction.

The pair of guiding mechanisms 22 are provided on the pair of second side walls 21*b* respectively, i.e., one guiding mechanism 22 is provided on each of the second side walls 21*b*. Specifically, the guiding mechanism 22 includes a plate body 22*a*, a guiding portion 22*b*, and mounting holes 22*c*, wherein a downward U-shaped groove is enclosed by the guiding portion 22*b* and the plate body 22*a*, the guiding mechanism 22 is hooked at the upper end surface of the second side wall 21*b* through the U-shaped groove, and the guiding mechanism 22 is slidable back and forth along the upper end surface of the second side wall 21*b*, thereby conveniently disassembling or assembling the guiding mechanism 22 and the first partition frame 232 from or to the accommodation cavity 10.

The first partition frame 232 is accommodated in the accommodation cavity 20, for dividing the accommodation cavity 20 in the front-rear direction. Specifically, the first partition frame 232 includes a partition element laterally arranged in the accommodation cavity 20 for dividing the accommodation cavity 20, the vertical plane where the partition element is located is defined as a partition plane of the first partition frame 232, and the accommodation cavity 20 is divided in the front-rear direction by taking the partition plane of the first partition frame 232 as a boundary. In the present embodiment, the partition element includes long transverse partition bars 232*a* and 232*b* which extend left and right and are arranged spaced apart from each other in the vertical direction.

The first partition frame 232 is slidably connected onto the body 21 in the front-rear direction through the guiding mechanism 22. The sliding of the first partition frame 232 may adjust the size and/or number of the storage partitions formed by dividing the accommodation cavity 20 in the front-rear direction, so as to meet diversified demands from different stored articles.

Specifically, the first partition frame 232 includes fixing portions 232*d* formed at left and right ends of the first partition frame 232, and the fixing portions 232*d* are fitted and connected into the mounting holes 22*c* of the guiding mechanism 22, so that the first partition frame 232 is slidably provided in the accommodation cavity 20 in the front-rear direction through the guiding mechanism 22. That is, when the guide mechanism 22 slides back and forth, the first partition frame 232 slides in the accommodation cavity 20 synchronously.

The fixing portions 232*d* extend in the left-right direction and may be inserted into the mounting holes 22*c* in the left-right direction. When the fixing portions 232*d* are inserted and fitted into the mounting holes 22*c* and the guiding mechanism 22 is hooked on the second side wall 21*b*, the guiding mechanism 22 is not able to move left and right with respect to the body 21, and the fixing portions 232*d* and the mounting holes 22*c* are mutually limited in the left-right direction, such that the fixing portions 232*d* are not able to move left and right with respect to the guiding mechanism 22, and thus the first partition frame 232 is not able to move left and right with respect to the body 21, thereby enhancing the stability of the first partition frame 232.

The second partition frame 231 is accommodated in the accommodation cavity 10 for dividing the accommodation cavity 20 in the left-right direction. In the present embodiment, the second partition frame 231 is rotatably connected onto the first partition frame 232 around a vertical axis t1 through a regulating assembly 24. According to the positional relation between the second partition frame 231 and the first partition frame 232, the storage device 200 has a folded state (referring to FIG. 7) and an unfolded state. In this way, the number of storage partitions formed by dividing the accommodation cavity 20 may be adjusted as needed, and the flexibility of dividing the accommodation cavity 20 is improved.

The second partition frame 231 includes a partition body for dividing the accommodation cavity 20, and the vertical plane where the partition body is located is defined as the partition plane of the second partition frame 231. A transverse width of the accommodation cavity 20 (that is, a spacing between the pair of second side walls 21*b*) is greater than a longitudinal width of the accommodation cavity 20 (that is, a spacing between the pair of first side walls 21*a*). Correspondingly, the width of the partition plane of the first partition frame 232 is greater than that of the partition plane of the second partition frame 231, i.e., a length of the partition element is greater than that of the partition body.

In the present embodiment, the partition body includes long longitudinal partition bars 231*a* and 231*b* which are parallel with each other and arranged spaced apart from each other in the vertical direction.

Figure 7:
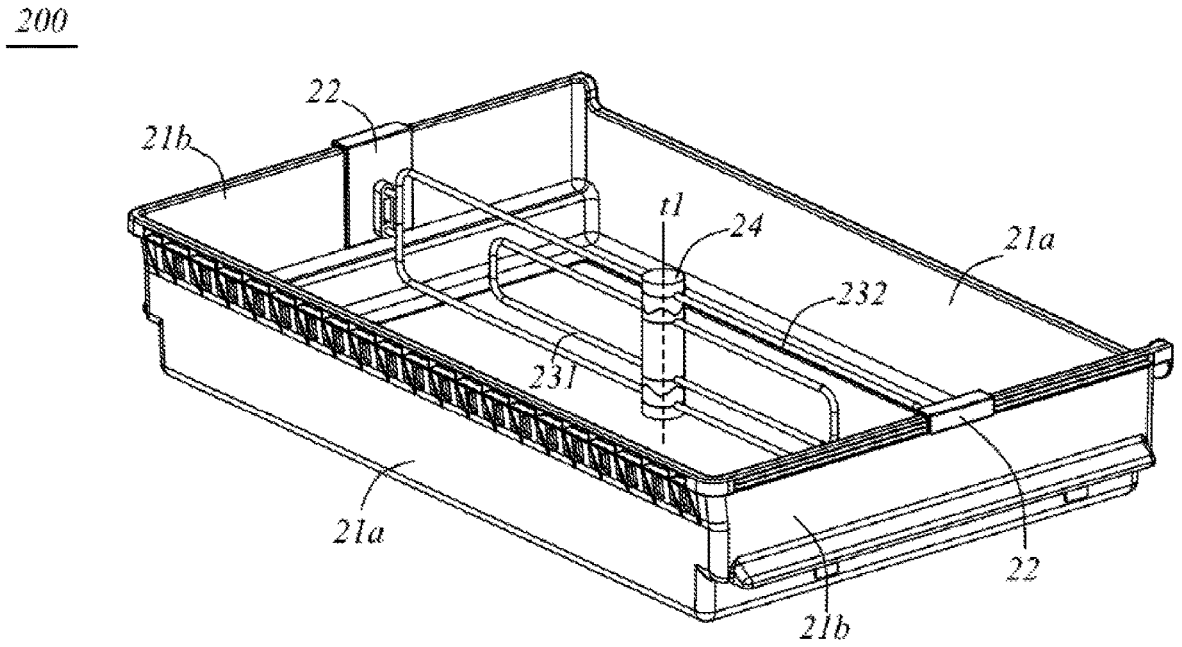
FIG. 7 is a structural diagram of a storage device according to a second embodiment of the present invention, wherein the storage device is in a folded state.
Figure 8:
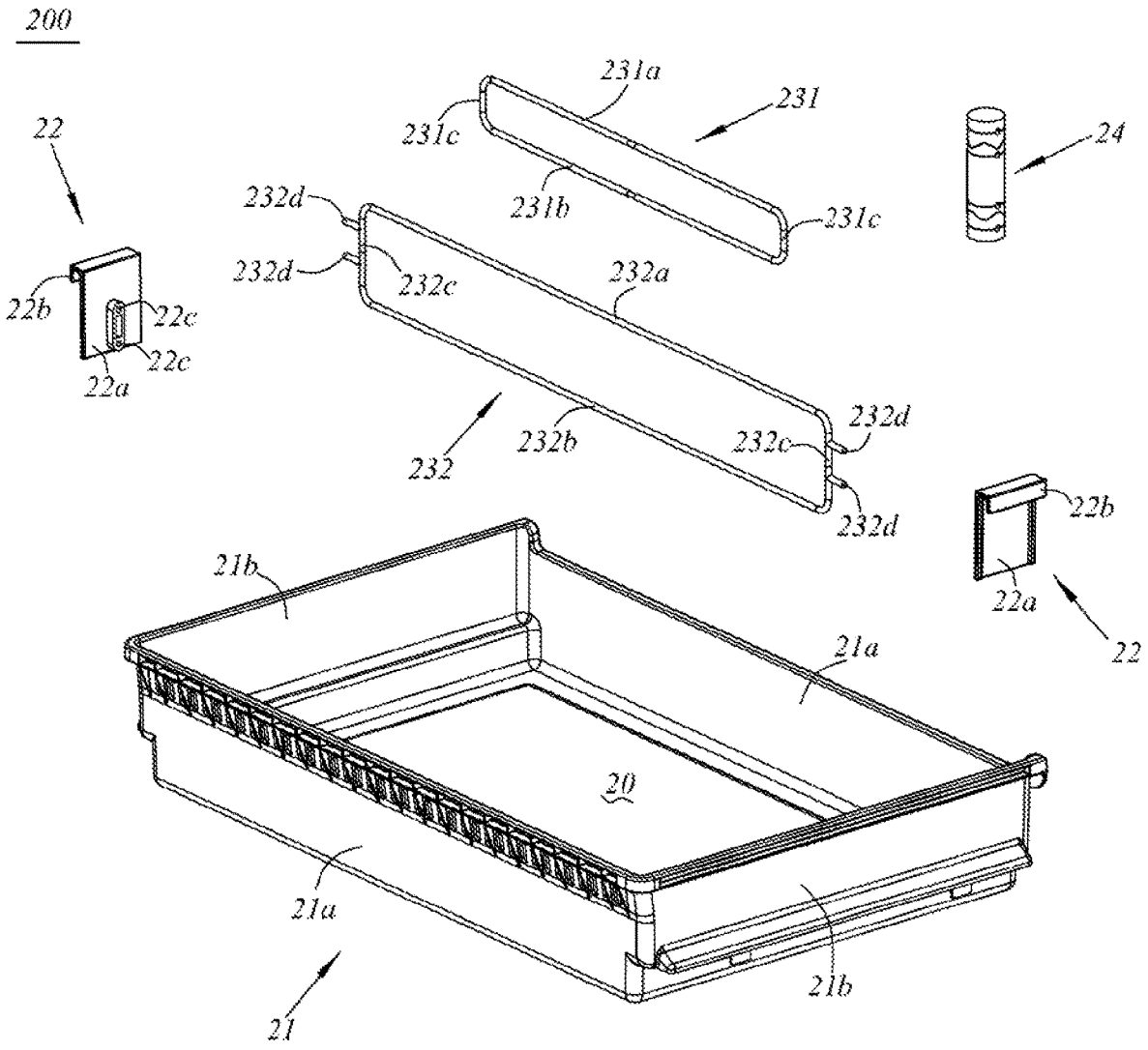
FIG. 8 is a structural exploded diagram of the storage device according to the second embodiment of the present invention.

Referring to FIG. 7, when the storage device 200 is in the folded state, the partition plane of the second partition frame 231 is coplanar with the partition plane of the first partition frame 232. The longitudinal partition bars 231*a*, 231*b* and the transverse partition bars 232*a*, 232*b* all extend in the left-right direction and are located in the same vertical plane. The transverse partition bar 232*a*, the longitudinal partition bar 231*a*, the longitudinal partition bar 231*b* and the transverse partition bar 232*b* are arranged sequentially in the vertical direction; when the storage device 200 is in the unfolded state, the second partition frame 231 is crossed with the first partition frame 232, the accommodation cavity 20 may be divided in the front-rear direction by taking the partition plane of the first partition frame 232 as a boundary, and in the left-right direction by taking the partition plane of the second partition frame 231 as a boundary. At this point, a non-zero included angle is formed between the partition plane of the second partition frame 231 and the partition plane of the first partition frame 232. In the present embodiment, at this point, the partition plane of the second partition frame 231 is perpendicular to the partition plane of the first partition frame 232. Specifically, the longitudinal partition bars 231*a*, 231*b* extend in the front-rear direction, the transverse partition bars 232*a*, 232*b* extend in the left-right direction, and the longitudinal partition bars 231*a*, 231*b* are perpendicular to the transverse partition bars 232*a*, 232*b*.

The second partition frame 231 further includes a pair of connecting rods 231*c* for connecting the end portions of the longitudinal partition bars 231*a* and 231*b*, and the connecting rods 331*c* are coplanar with the longitudinal partition bars 231*a*, 231*b*, and form a rectangular parallelepiped frame together with the longitudinal partition bars 231*a*, 231*b*.

Further, the second partition frame 231 may also be slidably connected onto the first partition frame 232 through the regulating assembly 24, i.e., the second partition frame 231 is not only slidable with respect to the first partition frame 232, but also rotatable around the vertical axis t1, thereby adjusting the number and/or size of the storage partitions formed by dividing the accommodation cavity 20 as needed.

The above-mentioned second partition frame 231 may be slidably connected onto the first partition frame 232 through the regulating assembly 24 in a plurality of manners. Firstly, the first partition frame 232 is not slidably connected to the regulating assembly 24, and the second partition frame 231 is slidably connected to the regulating assembly 24, thereby adjusting the size/number of the storage partitions formed by dividing the accommodation cavity 20 by the first partition frame 232 in the front-rear direction; secondly, the first partition frame 232 is slidably connected to the regulating assembly 24, and the second partition frame 231 is not slidably connected to the regulating assembly 24, thereby adjusting the size/number of the storage partition formed by dividing the accommodation cavity 20 by the second partition frame 231 in the left-right direction; thirdly, as in the present embodiment, the first partition frame 232 is slidably connected to the regulating assembly 24, and the second partition frame 231 is also slidably connected to the regulating assembly 24, thereby regulating the size/number of the storage partitions formed by dividing the accommodation cavity 10 by the first and second partition frames 232 and 231 in the front-rear direction and the left-right direction, and further improving the flexibility.

The specific structure of the adjusting assembly 24 according to the present embodiment is the same as that of the adjusting assembly 14 according to the embodiment 1, and is not be repeated herein. They only differs from each other in the mating relation between the adjusting assembly 24 and the first and second partition frames 232 and 231, which will be explained in detail below.

The regulating assembly 24 is provided as a cylindrical structure with mirror symmetry along a horizontal plane q'.

The regulating assembly 24 includes a second regulating mechanism which is fitted and connected with the first partition frame 232 and a first regulating mechanism which is fitted and connected with the second partition frame 231. In the present embodiment, there are provided two second regulating mechanisms, i.e., the second regulating mechanism 241*a* fitted and connected with the transverse partition bar 232*a* (its specific structure refers to that of the second regulating mechanism 141*a* according to the embodiment 1) and the second regulating mechanism 241*b* fitted and connected with the transverse partition bar 232*b* (its specific structure refers to that of the second regulating mechanism 141*b* according to the embodiment 1); there are also provided two first regulating mechanisms, i.e., the first regulating mechanism 242*a* fitted and connected with the transverse partition bar 231*a* (its specific structure refers to that of the first regulating mechanism 142*a* according to the embodiment 1) and the first regulating mechanism 242*b* fitted and connected with the transverse partition bar 231*b* (its specific structure refers to that of the first regulating mechanism 142*b* according to the embodiment 1); the first regulating mechanism 242*a* is matched with the second regulating mechanism 241*a*, and the first regulating mechanism 242*b* is matched with the second regulating mechanism 241*b*.

The first regulating mechanism 242*a* includes a first passage 245*a* through which, the longitudinal partition bar 231*a* passes. When the first regulating mechanism 242*a* is fitted and connected with the longitudinal partition bar 231*a*, the first regulating mechanism 242*a* slides along the longitudinal partition bar 231*a*; similarly, the first regulating mechanism 242*b* includes a first passage 245*b* through which, the longitudinal partition bar 231*b* passes. When the first regulating mechanism 242*b* is fitted and connected with the longitudinal partition bar 231*b*, the first regulating mechanism 242*b* slides along the longitudinal partition bar 231*b*. The first passage 245*a* is parallel with the first passage 245*b*, and the regulating assembly 24 is slidably fitted and connected onto the second partition frame 231.

The second regulating mechanism 241*a* includes a second passage 244*a* through which, the transverse partition bar 232*a* passes. When the second regulating mechanism 241*a* is fitted and connected with the transverse partition bar 232*a*, the second regulating mechanism 241*a* slides along the transverse partition bar 232*a*; similarly, the second regulating mechanism 241*b* includes a second passage 244*b* through which, the transverse partition bar 232*b* passes. When the second regulating mechanism 241*b* is fitted and connected with the transverse partition bar 232*b*, the second regulating mechanism 241*b* slides along the transverse partition bar 232*b*. The second passage 241*a* is parallel with the first passage 241*b*, and the regulating assembly 24 is slidably fitted and connected onto the first partition frame 232.

Further, the first and second regulating mechanisms 242*a* and 241*a* are fitted and connected with each other and are rotated around the vertical axis t1. In the present embodiment, the first regulating mechanism 242*a* is rotated around the vertical axis t1 (with reference to the body 21). Similarly, the first and second regulating mechanisms 242*b* and 241*b* are fitted and connected with each other and are rotated around the vertical axis t1. In the present embodiment, the first regulating mechanism 242*b* is rotated around the vertical axis t1 (with reference to the body 21).

Specifically, the regulating assembly 24 further includes a cam structure formed between the first and second regulating mechanisms. In the present embodiment, the number of the cam structures is two, i.e., the cam structure 243*a* formed between the first and second regulating mechanisms 242*a* and 241*a*, and the cam structure 243*b* formed between the first and second regulating mechanisms 242*b* and 241*b*. Certainly, in the variation, only one of the cam structures 243*a* and 243*b* may be provided.

Taking the cam structure 243*a* as an example, the specific structure of the cam structure will be described (the specific structure of the cam structure 243*b* refers to that of the cam structure 243*a*, and will not be repeated herein). The cam structure 243*a* includes a first concave-convex curved surface 431*a*' with a circumferentially-waved shape formed on an upper end surface of the first regulating mechanism 242*a*, and a second concave-convex curved surface 432*a*' with a circumferentially-waved shape formed on a lower end surface of the second regulating mechanism 241*a*, the first and second concave-convex curved surfaces 431*a*' and 423*a*' are fitted with each other; and when the first and second regulating mechanisms 242*a* and 241*a* are rotated around the vertical axis t with respect to each other, the second and first concave-convex curved surfaces 423*a*' and 431*a*' are butted against each other, such that the first and second regulating mechanisms 242*a* and 241*a* make reciprocating salutatory movements away from or close to each other in the vertical direction.

The cam structure 243*a* has at least two lowest engaging positions (referring to FIGS. 9*a* and 9*c*) where the second and first concave-convex curved surfaces 423*a*' and 431*a*' are fitted with each other concavely and convexly, and a highest butting position (referring to FIG. 9*b*) where the second and first concave-convex curved surfaces 423*a*' and 431*a*' are butted against each other concavely and convexly. When the cam structure 243*a* is moved from the lowest engaging position to the highest butting position, the first and second regulating mechanisms 242*a* and 241*a* are away from each other in the vertical direction; when the cam structure 243*a* is moved from the highest butting position to the lowest engaging position, the first and second regulating mechanisms 242*a* and 241*a* are close to each other in the vertical direction.

Figure 9A:
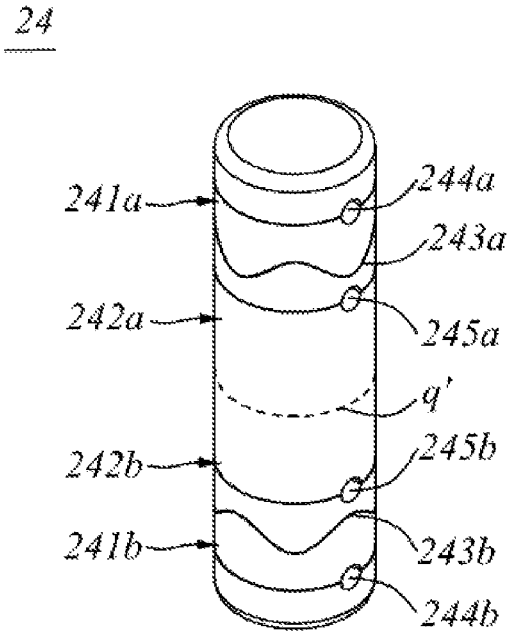
FIG. 9*a* is a structural diagram when an regulating assembly according to the second embodiment of the present invention is in a first engaged state.
Figure 9B:
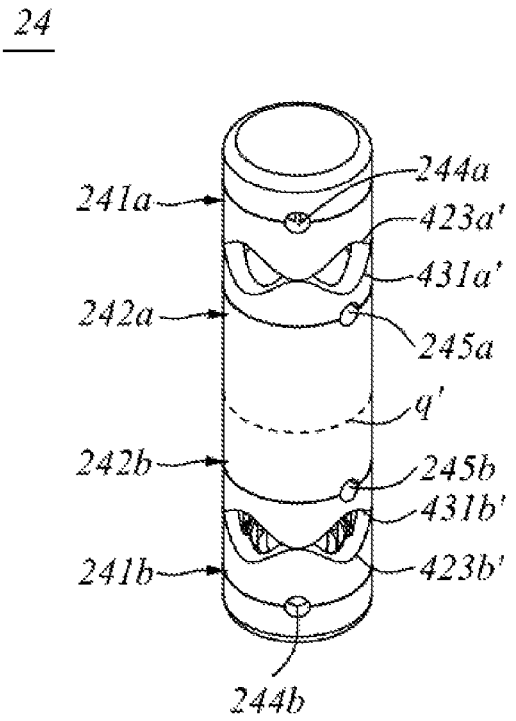
FIG. 9*b* is a structural diagram of the regulating assembly according to the second embodiment of the present invention in a critical state.
Figure 9C:
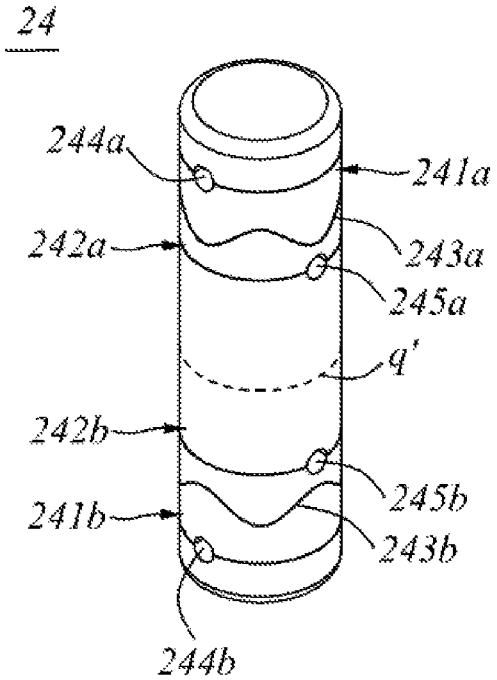
FIG. 9*c* is a structural diagram when the regulating assembly according to the second embodiment of the present invention is in a second engaged state.

When the second partition frame 231 is rotated around the vertical axis t1 with respect to the first partition frame 232, by taking the process of changing the storage device 200 from the folded state to the unfolded state (contrary to the process of changing the storage device 200 from the unfolded state to the folded state) as an example:

referring to FIG. 9*a*, when the storage device 200 is in the folded state, the regulating assembly 24 is in a first engaging state; at this point, the first passages 245*a*, 245*b* are parallel with the second passages 244*a*, 244*b*; correspondingly, the partition plane of the first partition frame 232 is parallel with that of the second partition frame 231, and the cam structures 243*a*, 243*b* are both at one of the lowest engaging positions;

referring to FIG. 9*b*, when the storage device 200 is switched from the folded state to the unfolded state, during the process that the regulating assembly 24 changes from the first engaging state into a critical state, the cam structures 243*a*, 243*b* are both moved from the lowest engaging position to the highest butting position, the first and second regulating mechanisms 242*a* and 241*a* are away from each other in the vertical direction, and the first and second regulating mechanisms 242*b* and 241*b* are away from each other in the vertical direction, until the regulating assembly 24 is in the critical state, and the cam structures 243*a*, 243*b* are both at the highest butting position; and then, during the process that the regulating assembly 24 changes from the critical state into the second engaging state, the first and second regulating mechanisms 242*a* and 241*a* are close to each other in the vertical direction, and the first and second regulating mechanisms 242*b* and 241*b* are close to each other in the vertical direction;

referring to FIG. 9*c*, when the storage device 200 is in the unfolded state, the regulating assembly 14 is in the second engaging state; at this point, the first passages 245*a*, 245*b* are perpendicular to the second passages 244*a*, 244*b*; correspondingly, the partition plane of the first partition frame 232 is perpendicular to that of the second partition frame 231, and the cam structures 243*a*, 243*b* are both at the other of the lowest engaging positions.

Further, the cam structures 243*a*, 243*b* are both configured as a circumferentially quartering structure, i.e., when the cam structures 243*a*, 243*b* are changed between the two adjacent lowest engaging positions, the first and second regulating mechanism 242*a* and 241*a* are rotated with respect to each other by 90° around the vertical axis t1, and the first and second regulating mechanisms 242*b* and 241*b* are rotated with respect to each other by 90° around the vertical axis t1. Further, the second partition frame 231 is rotated by 90° with respect to the first partition frame 232 around the vertical axis t, such that the storage device 200 is switched between the folded state and the unfolded state to finish a turnover cycle.

At the same time, when the cam structures 243*a*, 243*b* are changed between the lowest engaging position and the highest butting position, the first and second regulating mechanisms 242*a* and 241*a* are rotated with respect to each other by 45° around the vertical axis t1, and the first and second regulating mechanisms 242*b* and 241*b* are rotated with respect to each other by 45° around the vertical axis t1.

Certainly, in the variation, the cam structures 243*a*, 243*b* may also be configured as circumferentially inequant or multi-equant structures (such as the structure divided into three, five, six, eight equal parts, or the like) according to the specific requirements of a rotation angle of the storage device 200 switched from the folded state to the unfolded state. These variations do not deviate from the technical principle of the present invention.

Further, when the cam structures 243*a*, 243*b* are not at the lowest engaging position, the regulating assembly 24 is always subjected to an elastic driving force which drives the cam structures 243*a*, 243*b* to move to the lowest engaging position, i.e., the elasticity driving force drives the first and second regulating mechanisms 242*a* and 241*a* to have a tendency to be close to each other in the vertical direction and drives the first and second regulating mechanisms 242*b* and 241*b* to have a tendency to be close to each other in the vertical direction.

In the present embodiment, the elastic driving force is provided by the first partition frame 232. Specifically, the first partition frame 232 is made of a rigid material, and further includes a pair of connectors 232*c* for connecting the end portion of the transverse partition bar 232*a* and the end portion of the transverse partition bar 232*b*, a rectangular parallelepiped frame is enclosed by the connectors 232*c* and the transverse partition bars 232*a*, 232*b*; the first regulating mechanisms 242*a*, 242*b* are fixedly connected in the vertical direction. When the cam structures 243*a*, 243*b* are at the lowest engaging position, the first partition frame 232 is not elastically deformed, and the transverse partition bars 232*a*, 232*b* are parallel with each other and have an initial spacing; when the cam structures 243*a*, 243*b* are not at the lowest engaging position (including between the lowest engaging position and the highest butting position and at the highest butting position), driven by the second regulating mechanisms 241*a*, 241*b*, a local spacing of the transverse partition bars 232*a*, 232*b* close to the regulating assembly 24 is greater than the initial spacing, and the initial spacing is maintained at the end portion by the pulling of the connector 232*c*, and then the first partition frame 232 is elastically deformed, and applies the elastic driving force onto the regulating assembly 24.

In this way, in one turnover cycle of the storage device 200 switched between the folded state and the unfolded state: under the action of an external force, the second partition frame 231 is rotated with respect to the first partition frame 232 around the vertical axis t1, the regulating assembly 24 is changed from the first engaging state to the critical state (or from the second engaging state to the critical state), the cam structures 243*a*, 243*b* are both moved from the lowest engaging position to the highest butting position, the second regulating mechanisms 241*a*, 241*b* are away from each other in the vertical direction to drive the first partition frame 232 to be elastically deformed; when the regulating assembly 24 reaches the critical state, the cam structures 243*a*, 243*b* are both at the highest butting position, the first partition frame 232 is elastically deformed furthest; over the critical state, under the elastic restoring force of the first partition frame 232, the second regulating mechanisms 241*a*, 241*b* are close to each other in the vertical direction, and the regulating assembly 24 is changed from the critical state to the second engaging state (or from the critical state to the first engaging state), such that the storage device 200 is changed from the folded state to the unfolded state (or from the unfolded state to the folded state).

Certainly, in the variation, the storage device 200 may further include an elastic element which provides the elastic driving force, and the elastic element is provided between the first and second regulating mechanisms. When the cam structure is not at the lowest engaging position, the elastic element is elastically deformed.

Compared with the prior art, the storage device 200 according to the present embodiment may adjust the number/size of the storage partitions formed by dividing the accommodation cavity 20 as needed; moreover, the first partition frame 232 is conveniently disassembled and assembled, and has good stability in use.

Certainly, in the variation, there may be provided one first regulating mechanism, and its upper and lower ends are fitted and connected with one of the second regulating mechanisms; or the two second regulating mechanisms are fixedly connected in the vertical direction, and the two first regulating mechanisms are separately disposed, and when the regulating assembly is changed from the first engaging state to the critical state, the two first regulating mechanisms are moved close to each other in the vertical direction. None of these variations departs from the technical principle of the present invention.

The above detailed description only illustrates the feasible embodiments of the present invention, and is not intended to limit the protection scope of the present invention. Equivalent embodiments or modifications within the scope and spirit of the present invention shall be embraced by the protection scope of the present invention.

What is claimed is:

1. A storage device, comprising a body for enclosing an accommodation cavity, a regulating assembly and a first partition frame and a second partition frame for dividing the accommodation cavity, wherein the body comprises a bottom wall, a pair of first side walls and a pair of second side walls, the first partition frame is connected onto the pair of second side walls, the second partition frame is rotatably connected onto the first partition frame around a vertical axis through the regulating assembly, wherein the regulating assembly comprises:

a first regulating mechanism, fitted and connected with one of the first and second partition frames;

a second regulating mechanism, fitted and connected with the other of the first and second partition frames, wherein the first and second regulating mechanisms are rotatably connected with each other around the vertical axis, to drive the second and first partition frames to rotate with respect to each other;

a cam structure, comprising a first concave-convex curved surface formed on the first regulating mechanism and a second concave-convex curved surface formed on the second regulating mechanism;

when the first and second regulating mechanisms are rotated around the vertical axis with respect to each other, the second and first concave-convex curved surfaces are butted against each other, such that the first and second regulating mechanisms make reciprocating salutatory movements away from or close to each other in the vertical direction;

wherein the cam structure has at least two lowest engaging positions where the second and first concave-convex curved surfaces are fitted with each other concavely and convexly, and a highest butting position where the second and first concave-convex curved surfaces are butted against each other concavely and convexly; the second partition frame is rotated with respect to the first partition frame around the vertical axis, such that the storage device is switched between the folded state and the unfolded state; when the storage device is in the folded state, the cam structure is located at one of the lowest engaging positions; when the storage device is in the unfolded state, the cam structure is located at the other of the lowest engaging positions;

wherein when the first and second regulating mechanisms are rotated with respect to each other around the vertical axis and the cam structures are not at the lowest engaging position, the regulating assembly is always subjected to an elastic driving force which drives the cam structures to tend to move to the lowest engaging position, such that the first and second regulating mechanisms have a tendency to move close to each other in the vertical direction.

2. The storage device according to claim 1, wherein when the storage device is in the folded state, the partition plane of the second partition frame is coplanar with the partition plane of the first partition frame; when the storage device is in the unfolded state, the partition plane of the second partition frame is perpendicular to the partition plane of the first partition frame.

3. The storage device according to claim 2, wherein the cam structure is configured as a circumferentially quartering structure.

4. The storage device according to claim 1, wherein the number of the first regulating mechanisms is one or more fixed mutually in the vertical direction, and the number of the second regulating mechanisms is two; when the first and second regulating mechanisms are rotated with respect to each other around the vertical axis, the two second regulating mechanisms are moved away from or close to each other in the vertical direction to enable the first or second partition frame fitted and connected with the second regulating mechanism to be deformed elastically; when the cam structures are not at the lowest engaging position the first or second partition frame which is elastically deformed applies the elastic driving force onto the regulating assembly under the action of its elastic restoring force.

5. The storage device according to claim 4, wherein two first regulating mechanisms are fixedly connected with each other, and are provided at upper and lower sides of the two first regulating mechanisms respectively.

6. The storage device according to claim 1, wherein the second partition frame is slidably connected onto the first partition frame through the regulating assembly; the first partition frame comprises a transverse partition bar which extends in a left-right direction and is configured for dividing the accommodation cavity, the second partition frame comprises a longitudinal partition bar for dividing the accommodation cavity; the first regulating mechanism comprises a first passage, through which, one of the transverse partition bar and the longitudinal partition bar slidably passes; the second regulating mechanism comprises a second passage, through which, the other of the transverse partition bar and the longitudinal partition bar slidably passes.

7. The storage device according to claim 6, wherein the first regulating mechanism comprises a third member and a fourth member connected with each other, and the first passage is formed between the third member and the fourth member;

the second regulating mechanism comprises a first member and a second member connected with each other, and the second passage is formed between the first and second members.

8. The storage device according to claim 1, wherein the first regulating mechanism comprises a mating pin, and the second regulating mechanism comprises a mating hole which is fitted and connected with the mating pin; when the mating pin is fitted and connected with the mating hole, the relative movement of the first and second regulating mechanisms in the horizontal direction is limited.

9. A refrigerator, comprising the storage device according to claim 1.

10. A storage device, comprising a body for enclosing an accommodation cavity, a regulating assembly and a first partition frame and a second partition frame for dividing the accommodation cavity, wherein the body comprises a bottom wall, a pair of first side walls and a pair of second side walls, the first partition frame is connected onto the pair of second side walls, the second partition frame is rotatably connected onto the first partition frame around a vertical axis through the regulating assembly, wherein the regulating assembly comprises:

a first regulating mechanism, fitted and connected with one of the first and second partition frames;

a second regulating mechanism, fitted and connected with the other of the first and second partition frames, wherein the first and second regulating mechanisms are rotatably connected with each other around the vertical axis, to drive the second and first partition frames to rotate with respect to each other;

a cam structure, comprising a first concave-convex curved surface formed on the first regulating mechanism and a second concave-convex curved surface formed on the second regulating mechanism;

when the first and second regulating mechanisms are rotated around the vertical axis with respect to each other, the second and first concave-convex curved surfaces are butted against each other, such that the first and second regulating mechanisms make reciprocating salutatory movements away from or close to each other in the vertical direction;

wherein the cam structure has at least two lowest engaging positions where the second and first concave-convex curved surfaces are fitted with each other concavely and convexly, and a highest butting position where the second and first concave-convex curved surfaces are butted against each other concavely and convexly; the second partition frame is rotated with respect to the first partition frame around the vertical axis, such that the storage device is switched between the folded state and the unfolded state; when the storage device is in the folded state, the partition plane of the second partition frame is coplanar with the partition plane of the first partition frame, and the cam structure is located at one of the lowest engaging positions; when the storage device is in the unfolded state, the partition plane of the second partition frame is perpendicular to the partition plane of the first partition frame, and the cam structure is located at the other of the lowest engaging positions;

wherein when the first and second regulating mechanisms are rotated with respect to each other around the vertical axis and the cam structures are not at the lowest engaging position, the regulating assembly is always subjected to an elastic driving force which drives the cam structures to tend to move to the lowest engaging position, such that the first and second regulating mechanisms have a tendency to move close to each other in the vertical direction.

11. The storage device according to claim 10, wherein the cam structure is configured as a circumferentially quartering structure.

12. The storage device according to claim 10, wherein the number of the first regulating mechanisms is one or more fixed mutually in the vertical direction, and the number of the second regulating mechanisms is two; when the first and second regulating mechanisms are rotated with respect to each other around the vertical axis, the two second regulating mechanisms are moved away from or close to each other in the vertical direction to enable the first or second partition frame fitted and connected with the second regulating mechanism to be deformed elastically; when the cam structures are not at the lowest engaging position the first or second partition frame which is elastically deformed applies the elastic driving force onto the regulating assembly under the action of its elastic restoring force.

13. The storage device according to claim 12, wherein two first regulating mechanisms are fixedly connected with each other, and are provided at upper and lower sides of the two first regulating mechanisms respectively.

14. The storage device according to claim 10, wherein the second partition frame is slidably connected onto the first partition frame through the regulating assembly; the first partition frame comprises a transverse partition bar which extends in a left-right direction and is configured for dividing the accommodation cavity, the second partition frame comprises a longitudinal partition bar for dividing the accommodation cavity; the first regulating mechanism comprises a first passage, through which, one of the transverse partition bar and the longitudinal partition bar slidably passes; the second regulating mechanism comprises a second passage, through which, the other of the transverse partition bar and the longitudinal partition bar slidably passes.

15. The storage device according to claim 14, wherein the first regulating mechanism comprises a third member and a fourth member connected with each other, and the first passage is formed between the third member and the fourth member;

the second regulating mechanism comprises a first member and a second member connected with each other, and the second passage is formed between the first and second members.

16. The storage device according to claim 10, wherein the first regulating mechanism comprises a mating pin, and the second regulating mechanism comprises a mating hole which is fitted and connected with the mating pin; when the mating pin is fitted and connected with the mating hole, the relative movement of the first and second regulating mechanisms in the horizontal direction is limited.

* * * * *